US007485798B2

(12) United States Patent
Nishida

(10) Patent No.: US 7,485,798 B2
(45) Date of Patent: Feb. 3, 2009

(54) KEYBOARD APPARATUS

(75) Inventor: Kenichi Nishida, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 89 days.

(21) Appl. No.: 11/490,554

(22) Filed: Jul. 20, 2006

(65) Prior Publication Data

US 2007/0017342 A1 Jan. 25, 2007

(30) Foreign Application Priority Data

Jul. 21, 2005 (JP) ..... 2005-211649

(51) Int. Cl.
*G10H 1/00* (2006.01)

(52) U.S. Cl. ..... 84/644; 84/670; 84/719; 84/744; 84/18; 84/20

(58) Field of Classification Search ..... 84/615, 84/644, 670, 718–720, 743–745, 17–23
See application file for complete search history.

(56) References Cited

U.S. PATENT DOCUMENTS

| | | | | | |
|---|---|---|---|---|---|
| 488,482 | A | * | 12/1892 | Pain | 84/19 |
| 753,809 | A | * | 3/1904 | Powers | 84/21 |
| 1,088,499 | A | * | 2/1914 | White | 84/18 |
| 1,104,282 | A | * | 7/1914 | Severy | 84/20 |
| 1,198,070 | A | * | 9/1916 | Severy | 84/20 |
| 2,821,880 | A | * | 2/1958 | Ahola | 84/21 |
| 3,724,097 | A | * | 4/1973 | Schmoyer | 84/478 |
| 4,903,571 | A | * | 2/1990 | Coles | 84/442 |
| 5,003,859 | A | * | 4/1991 | Monte et al. | 84/423 R |
| 5,065,661 | A | * | 11/1991 | Hacker | 84/719 |
| 5,115,705 | A | * | 5/1992 | Monte et al. | 84/617 |
| 5,210,367 | A | * | 5/1993 | Taguchi et al. | 84/746 |
| 5,335,574 | A | * | 8/1994 | Matsunaga et al. | 84/21 |
| 5,883,327 | A | * | 3/1999 | Terada et al. | 84/653 |
| 6,156,963 | A | * | 12/2000 | Masubuchi et al. | 84/423 R |

FOREIGN PATENT DOCUMENTS

| | | |
|---|---|---|
| JP | 9-198037 | 7/1997 |
| JP | 2003-42206 | 2/2003 |

* cited by examiner

*Primary Examiner*—David S. Warren
(74) *Attorney, Agent, or Firm*—Morrison & Foerster LLP

(57) ABSTRACT

Key frame has a key support section that pivotably supports thereon a plurality of keys. Hammer structures are pivotably provided in corresponding relation to and below the keys, each of which pivots in interlocked relation to depression operation of a corresponding one of the keys. On a rear portion of the key frame, there is provided an upper stopper that is elongated and extends in a direction where the keys are arranged. The upper stopper defines an upper end limit of pivoting movement of each of the hammer structures. Opening portion is formed between the key support section and the upper stopper. Wiring cable connected to a circuit board, having switches corresponding to the keys, is run below the key support section, then passed through the opening portion and thence drawn upwardly beyond the upper stopper so that it is led out to a region above the upper stopper.

4 Claims, 5 Drawing Sheets

KEYBOARD APPARATUS

BACKGROUND OF THE INVENTION

The present invention relates to keyboard apparatus equipped with hammer structures pivotably provided beneath individual keys.

Examples of keyboard apparatus of the type equipped with hammer structures pivotably provided beneath individual keys are disclosed in Japanese Patent Application Laid-open Publication Nos. H9-198037 (hereinafter referred to as "patent literature 1") and 2003-42206 (hereinafter referred to as "patent literature 2"). In the keyboard apparatus disclosed in patent literature 1 identified above, each of white and black keys is pivotably supported at its rear end portion by a frame and normally biased by a leaf spring. Further, a pivot lever, including a lever base and weight, is provided as a hammer structure beneath each of the keys, and the pivot lever is driven by a driving section provided on the key. The key is returned to its original position by the resilient force of the leaf spring as depression of the key is released.

In the keyboard apparatus disclosed in patent literature 2 identified above, each key is supported at its rear end support portion by a keyboard frame, a mass member of a hammer structure is disposed beneath the key, and the key and mass member are held by an S-shaped spring. The mass member is driven by a downwardly-projecting portion formed on the key. Also disclosed is a structure for pivotably holding each key by means of a V-shaped spring.

In electronic keyboard instruments equipped with movable sections, such as hammer structures, it is necessary to take into account installation of an electric wiring cable from a switch circuit board on which are mounted key switches for detecting ON/OFF states of individual keys of the keyboard apparatus. If the wiring cable is installed improperly, e.g., if the wiring cable contacts a movable component, such as a key, there would be encountered the problems that the key touch feeling is adversely influenced, mechanical noise, such as rubbing noise, occurs, and, in some case, the wiring cable is impaired to produce an electrical trouble. Further, if the wiring cable is taken into account with priority, there would arise the problem that the hammer structures etc. are subjected to design-related limitations.

In order to avoid unwanted contacts and interferences between the driving sections, such as the hammer structures and keys, and the wiring cable, it is conceivable to, for example, install the wiring cable so as to exit from opposite sides pf the keyboard; in this case, however, the wiring cable has to have an increased length for connection with a main circuit board. Particularly, in the case where a leaf spring (e.g., S-shaped spring) etc. are to be provided beneath each key as in the keyboard apparatus disclosed in patent literature 1 or 2, there arises another need to avoid interferences between the leaf springs etc. and the wiring cable.

SUMMARY OF THE INVENTION

In view of the foregoing, it is an object of the present invention to provide an improved keyboard apparatus which can impart a good key touch feeling through appropriate action of a hammer structure and which allows a wiring cable to be appropriately installed from a switch circuit board, disposed beneath keys, with no interference between the cable and the hammer structures.

In order to accomplish the above-mentioned object, the present invention provides an improved keyboard apparatus, which comprises: a plurality of keys; a key frame that pivotably supports the plurality of keys by a key support section thereof; a circuit board provided below the keys and having switches corresponding to the keys; a plurality of hammer structures pivotably provided on the key frame in corresponding relation to and below the keys, each of the hammer structures pivoting in interlocked relation to depression operation of a corresponding one of the keys; and an upper stopper provided on a rear portion of the key frame and elongated and extending in a direction where the keys are arranged (i.e., key-arranged direction), the upper stopper defining an upper end limit of pivoting movement of each of the hammer structures, an opening portion being formed between the key support section and the upper stopper. In the keyboard apparatus of the present invention, a wiring cable connected to the circuit board is run below the key support section of the key frame, then passed through the opening portion and thence drawn upwardly beyond the upper stopper so that the wiring cable is led out to a region behind the key frame.

According to the present invention, the wiring cable connected to the circuit board is installed in such a manner that it first runs below the key support section of the key frame, then passes through the opening portion and thence extends upwardly beyond the upper stopper so that the wiring cable is ultimately led out to a region behind the key frame. Besides, upward pivoting movement of each of the key structures is limited by the upper stopper. With such arrangements, it is possible to avoid unwanted interference between the cable and the hammer structures. Because the wiring cable connected to the circuit board, having switches corresponding to the keys, can be installed so as to extend up to a region behind the key frame without interference between the cable and the hammer structures, the present invention can achieve various benefits; for example, it allows the cable to be readily connected to a main circuit board provided behind the key frame even where the cable has a relatively small length.

In an embodiment, the plurality of keys are included in a key unit, the key unit is integrally formed of synthetic resin to provide a fixation section and small-thickness portions, and the plurality of keys are connected with the fixation section via respective ones of the small-thickness portions. The keys are pivotable relative to the fixation section by resiliency of the respective small-thickness portions, and the fixation section is supported by the key support section of the key frame. Because each of the keys in the key unit can be returned, by the resiliency of the corresponding small-thickness portion, to its original position after depression operation, the present invention can eliminate a need for particular key-returning springs and thereby achieve cost reduction. The installation of the wiring cable can be made even easier by thus dispensing with the key-returning springs and the integral formation of the key unit can significantly simplify the construction for supporting the keys, with the result that the cost of the keyboard apparatus can be even further reduced.

In another embodiment, the keyboard apparatus further comprises an upwardly-opening wall section provided on the key frame above the upper stopper in positional correspondence with the opening portion formed between the key support section and the upper stopper, and the wiring cable drawn upwardly beyond the upper stopper through the opening portion is led out rearwardly to the above-mentioned region through an upward opening of the wall section. Because the wiring cable passed through the upward opening of the wall section can be held by the wall section surrounding the cable, it is possible to reliably avoid interference between the cable and surrounding components.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
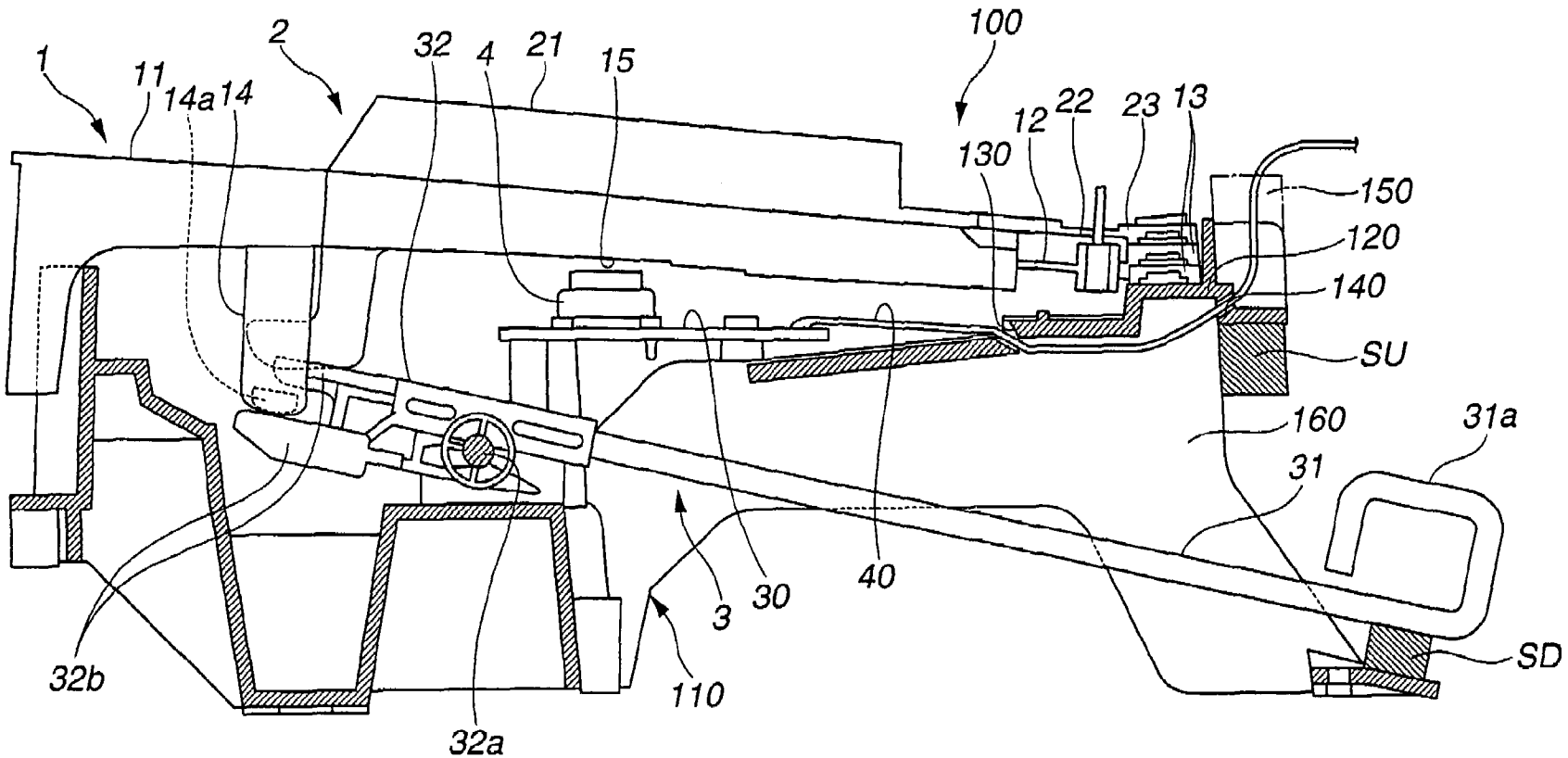
FIG. 1 is a sectional side view showing essential parts of a keyboard apparatus in accordance with an embodiment of the present invention.
Figure 2A:
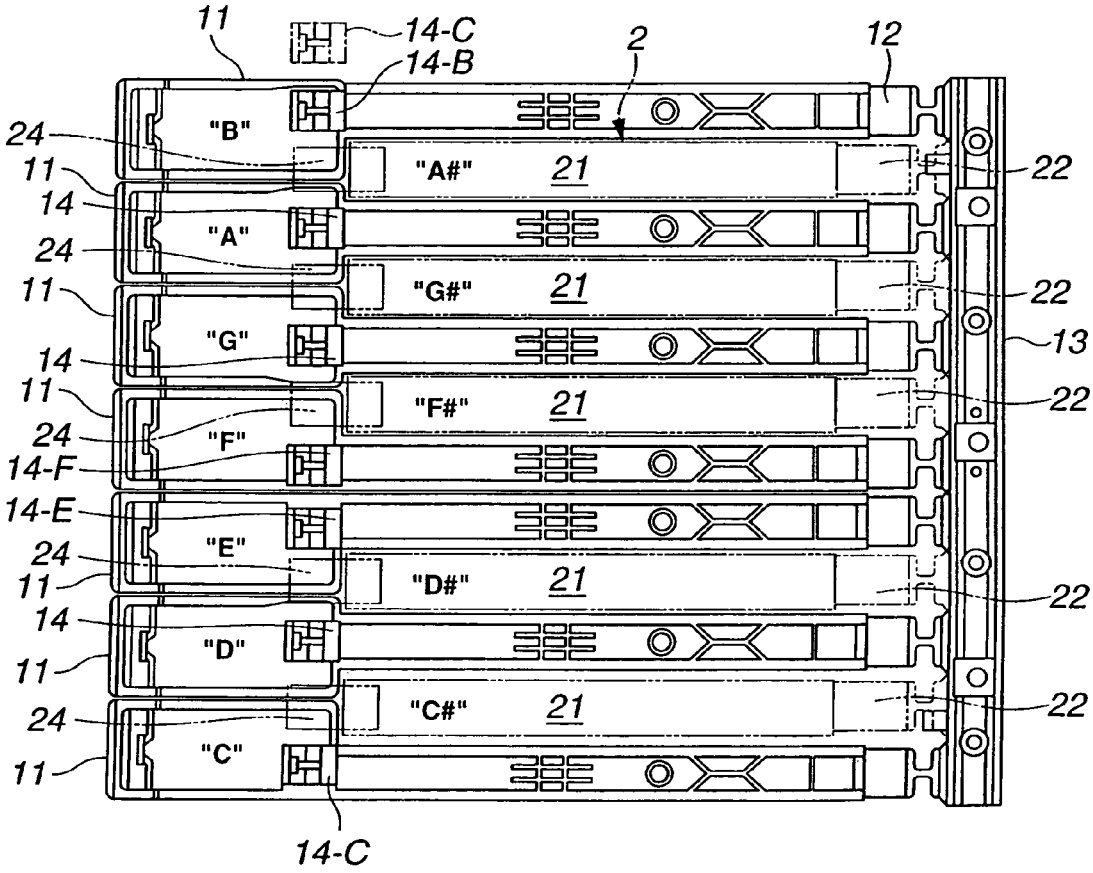
FIGS. 2A and 2B are a plan view and sectional side view, respectively, of a white key unit in the embodiment of the keyboard apparatus of FIG. 1.
Figure 2B:
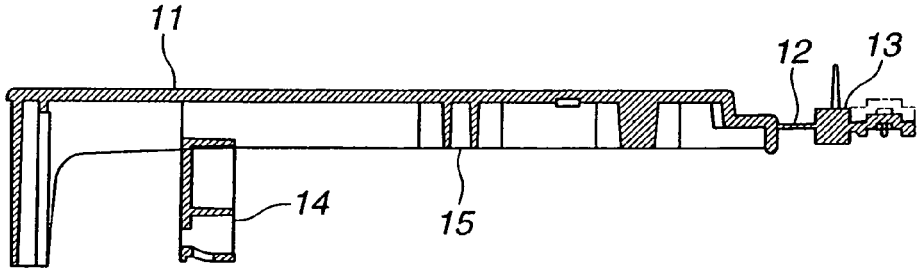
Figure 3A:
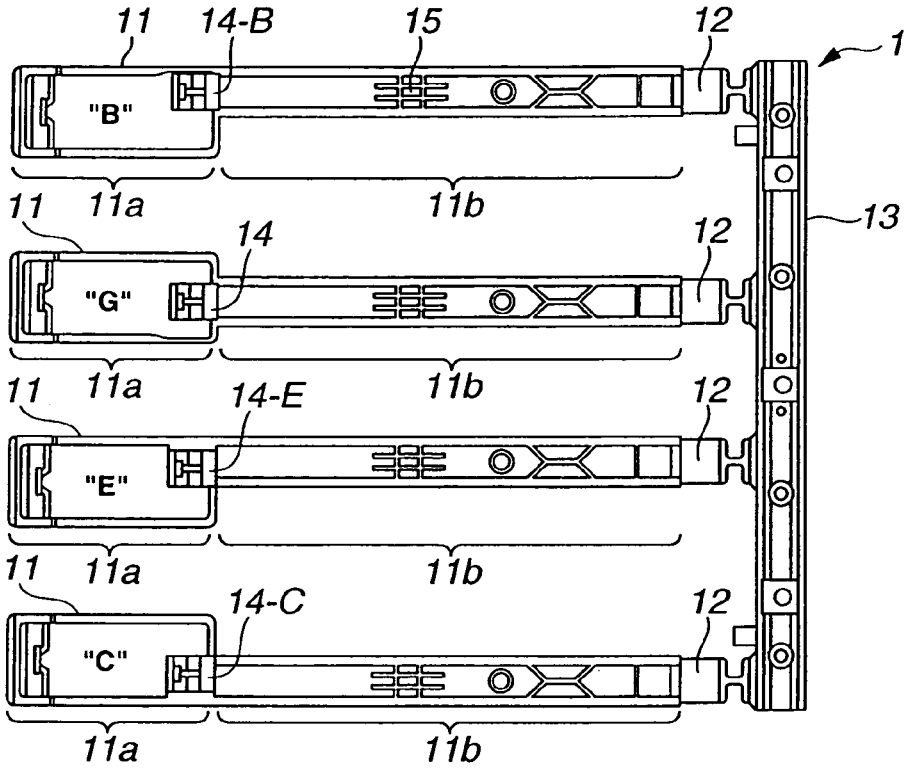
FIGS. 3A and 3B are exploded plan views of the white key unit in the embodiment.
Figure 3B:
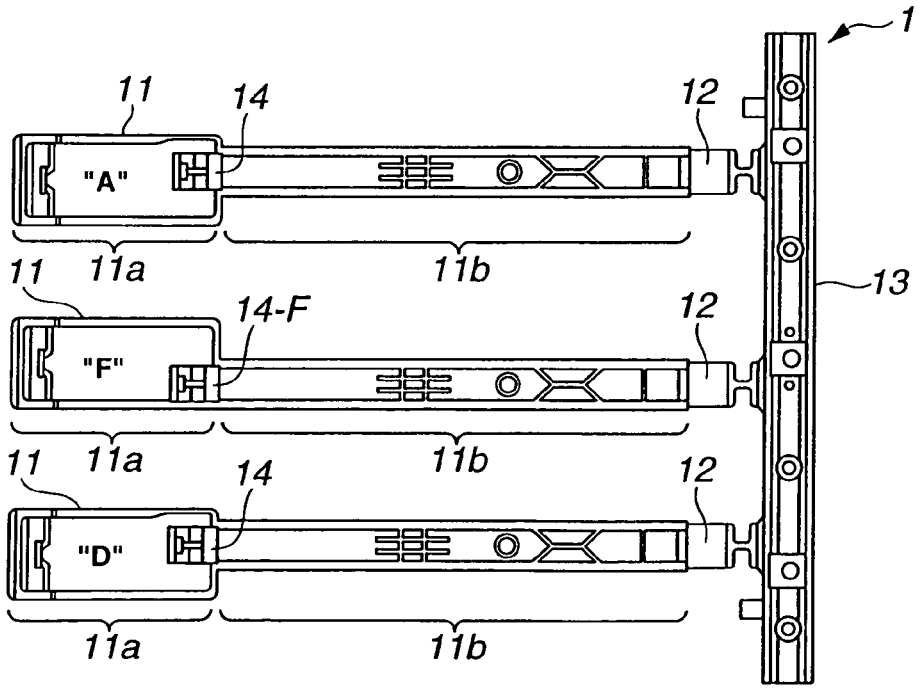
Figure 4:
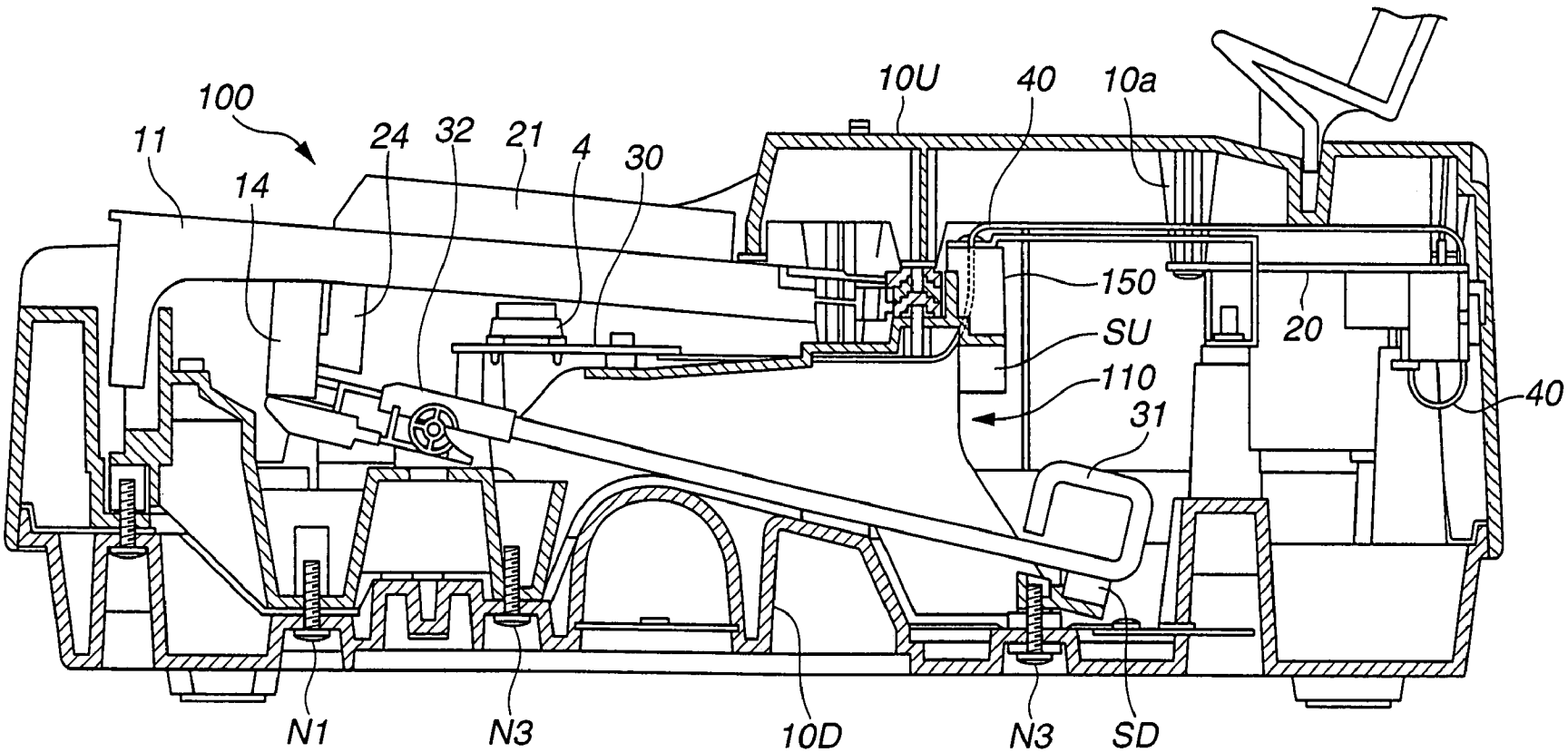
FIG. 4 is a sectional side view of an electronic musical instrument employing the embodiment of the keyboard apparatus.

FIG. 1 is a sectional side view showing essential parts of a keyboard apparatus in accordance with an embodiment of the present invention, FIGS. 2A and 2B are a plan view and sectional side view, respectively, of a white key unit in the keyboard apparatus, FIGS. 3A and 3B are exploded plan views of the white key unit, and FIG. 4 is a sectional side view of an electronic musical instrument employing the keyboard apparatus of the present invention. Note that a left side in each of FIGS. 1-5 is a side closer to a human player of the keyboard and a direction perpendicular to the sheet of each of FIGS. 1 to 4 is a direction in which keys of the keyboard apparatus are arranged (i.e., key-arranged direction). In the following description, a side of the electronic musical instrument and keyboard apparatus closer to the human player playing the keyboard will be referred to as "front", while the opposite side from the human player will be referred to as "rear". Further, in the following description and accompanying drawings, reference characters used to identify tone pitches (pitch names) are each indicated by a combination of a numeral, hyphen and upper-case alphabetical letter. Further. in some cases, "white keys" and "black keys" will be generically referred to as "keys".

In the electronic musical instrument, as best seen in FIG. 4, a body case comprises a lower case 10D and an upper case 10U, and a key frame 110 of the keyboard apparatus 100 is fixed to the lower case 30D by means of screws N1, N2 and N3. Such fixation by the screws N1, N2 and N3 is employed at a plurality of positions along the direction the keys of the keyboard apparatus 100 are arranged (i.e., key-arranged direction). In the keyboard apparatus 100, the keys 11 and 21 are supported by the key frame 110 as will be later detailed, and the upper case 10U is formed to cover respective rear portions of the keys 11 and 21 of the keyboard apparatus 100. Main circuit board 20 is fixed, via bosses 10*a* etc., to a rear inner surface portion of the upper case 10U behind the keys 11 and 21.

As shown in FIGS. 3A and 3B, a white key unit 1 comprises a plurality of the white keys 11, small-thickness portions 12 integrally connected with the rear ends of the individual keys 11, and a common fixation portion 13 integrally connecting together the rear ends of the small-thickness portions 12 in the key unit 1. These keys 11, small-thickness portions 12 and common fixation portion 13 of the white key unit 1 are integrally formed of white synthetic resin. The first key unit 1 is an integrally-formed unit of four white keys 11 ("C", "E", "G" and "B" keys) as seen in FIG. 3A, and the second key unit 1 is an integrally-formed unit of three white keys 11 ("D", "F" and "A" keys) as seen in FIG. 3B.

Similarly to the white key unit 1 and as indicated in two-dot-dash lines, a black key unit 2 comprises a plurality of the keys 21, small-thickness portions 22 integrally connected with the rear ends of the individual keys 21, and a common fixation portion 23 integrally connecting together the rear ends of the small-thickness portions 22 in the key-arranged direction (see FIG. 1). These keys 21, small-thickness portions 22 and common fixation portion 23 of the black key unit 2 are integrally formed of black synthetic resin. The black key unit 2 is an integrally-formed unit of five black keys 21 ("C#", "D#", "F#", "G#" and "A#" keys). The white and black key units 1 and 2 are combined, in accordance with predetermined arrangement of the keys 11 and 21, to thereby constitute a keyboard unit comprising keys of one octave. Further, a plurality of such keyboard units, corresponding to a necessary number of octaves, are combined to provide the keyboard apparatus of the present invention.

As shown in FIGS. 3A and 3B, each of the white keys 11 has a wide (i.e., increased-width) portion 11*a* located closer to the human player playing the keyboard, and a narrow (i.e., reduced-width) portion 11*b* formed rearwardly of the wide portion 11*a*. In the keyboard unit duly assembled, one black key 21 is located between the narrow portions 11*b* of two adjoining white keys 11. Further, each of the white keys 11 also has an actuating portion 14 formed on the reverse or underside surface of the wide portion 11*a* and extending downward from the underside surface adjacent to the narrow portions 11*b*. Each of the black keys 21 has an actuating portion 24 formed on the underside surface of the distal end thereof. Whereas the actuating portions 14 and 24 are each in the form of a small projecting piece, each of them may be in the form of a columnar member.

As shown in FIG. 1, the keyboard apparatus 100 further includes a key fixation base 120 provided on a rear upper end of the key frame 110, and the key fixation base 120 is elongated in shape in the key-arranged direction and extends in correspondence with all of the keys. The common fixation sections 13 of the first and second white key units 1 and common fixation section 23 of the black key unit 2 are mounted to the key fixation base 120. Thus, the individual keys 11 and 12 are pivotably supported by resiliency of the small-thickness portions 12 and 22. Namely, the small-thickness portions 12 and 22 function as hinges, and the key fixation base 120 constitutes a "key support section" in the keyboard apparatus of the present invention.

A plurality of hammer structures 3 are provided in corresponding relation to the keys 11 and 12. Beneath each of the keys 11 and 12, the hammer structure 3 is supported by the key frame 110. Each of the hammer structures 3 comprises a mass rod 31 extending in the front-rear direction of the keyboard apparatus, and an actuation section 32 holding an end of the mass rod 31. The hammer structure 3 is supported by the key frame 110, via a shaft 32*a* of the actuation section 32, for vertical pivotal movement with the shaft 32*a* functioning as a supporting point. The actuation section 42 has at its distal end a pair of vertically-spaced connecting pieces 32*b*, and a connecting plate 14*a* formed at the lower end of the actuating portion 14 of the key 11 is connected to the connecting pieces 32*b*. As the key 11 is depressed by the human player, the actuating portion 14 of the key 11 depresses the actuation section 32 of the hammer structure 3 so that the hammer structure 3 pivots about the shaft 32*a* in a counterclockwise direction of the figure. Conversely, as the key 11 is released, the hammer structure 3 pivots in a clockwise direction of the figure due to the empty weight of the mass rod 31, and the key 11 returns to its original position through cooperation of the hammer structure 3 and resilient force of the small-thickness portion 12 of the key 11. Stoppers SD and SU, formed of felt or the like, are fixed to predetermined rear lower end and rear upper end portions of the key frame 110, and the vertical pivoting range of the hammer structure 3 is limited by these stoppers SD and SU. The stopper SU constitutes an "upper stopper" that defines an upper end limit of the vertical pivoting range of the hammer structure 3. The stoppers SD and SU are each elongated and extend in the key-arranged direction in correspondence with (i.e., to operate for) all of the keys. More specifically, the upper end limit of the vertical pivoting range of the hammer structure 3 is determined by the mass rod 31 abutting against the upper stopper SU, while the lower end limit of the vertical pivoting range is determined by the mass rod 31 abutting against the lower stopper SD.

Below the keys 11 of the keyboard apparatus 100, a switch circuit board 30 is supported by the key frame 110. On the switch circuit board 30, there are provided a plurality of key switches 4 formed of dome-shaped rubber and corresponding to the keys. Each of the key switches 4 is a key-depression detecting switch turned on/off by a switch driving portion 15 (see FIG. 3A) provided on the underside of the corresponding key 11; normally, two or more such key switches, rather than just one key switch, are provided per key, to permit detection of key touch etc. On the switch circuit board 30, the key switches 4 of the individual keys are arranged and connected together in a matrix configuration to thereby provide a key switch matrix circuit, and a flat cable 40, comprising a set of plurality of wiring lines, is connected so as to pass input/output signals to/from the key matrix circuit. Namely, the switch circuit board 30 is a "circuit board" and the flat cable 40 is a "wiring cable" in the keyboard apparatus of the present invention.

Further, a slit 130 is formed in a predetermined portion of the key frame 110 between the key fixation base 120 and the switch circuit board 30, and another slit 140 is formed in a predetermined rear end portion of the key fixation base (key support section) 120 and opens upwardly from beneath the key frame 110; the slit 140 constitutes an "upward opening portion" in the keyboard apparatus of the present invention. Retaining member 150 in the form of a rectangular cylinder is mounted to the rear end portion behind the slit 140. Part or the whole of a side surface of the retaining member 150 constitutes a "wall section", and the retaining member 150 opens upwardly to allow the flat cable 40 to be led out upwardly through the alit 140 and member 150. More specifically, the slits 130 and 140 and retaining member 150 each have a width (i.e., dimension in the key-arranged direction) corresponding to the width of the flat cable 40, which may be, for example, in the order of a few centimeters. The flat cable 40 is passed through the slits 130 and 140 into a bottom portion of the retaining member 150, then drawn upwardly through the interior of the retaining member 150, and thence led out from the retaining member 150 via the upper end (i.e., upward opening of the wall section) of the retaining member 150, to ultimately connect to the main circuit board 20 provided in a rear end region of the keyboard apparatus (see FIG. 4). In this way, electric lead wires connecting between the switch circuit board 30 and the main circuit board 20 are put together in one place or in one bundle, which greatly facilitates necessary assembling operation etc.

Further, the retaining member 150 is shaped to extend upwardly from the upper stopper SU toward the upper case 10U, and the flat cable 40, exiting from the upper end of the retaining member 150, extends horizontally rearward. The flat cable 40, passed through the slit 140, can be retained by the retaining member 150 snugly surrounding the flat cable 40, and thus, it is possible to reliably prevent interference between the flat cable 40 and various other components around the flat cable 40. For example, the mass rod 31 of each of the hammer structures 3 has an upwardly-bent distal end portion 31*a* to function as a weight. However, when a linear body portion of the mass rod 31 is in a position where it abuts against and is thereby held in place by the upper stopper SU, the uppermost end of the upwardly-bent distal end portion 31*a* is located higher than the upper stopper SU. Thus, if the wall section of the retaining member 150 does not have an appropriate height, there is a great possibility of the flat cable 40, exiting from the upper end of the upward opening defined by the wall section of the retaining member 150, being interfered with by the upwardly-bent distal end portion 31*a* of the mass rod 31. Therefore, it is desirable that the height of the upward opening of the wall section of the retaining member 150 be at a same height as or higher than the top of the upwardly-bent distal end portion 31*a* of the mass rod 31 when the hammer structure 3 is in the position where it is held in place by the upper stopper SU.

As set forth above, the flat cable 40, connected to the switch circuit board 30, is passed through a lower end portion of the key fixation base 120 of the key frame 110 and then through the slit 140 formed between the key fixation base 120 and the upper stopper SU, and then the flat cable 40 is drawn, by way of a region above the upper stopper SU, over to a rear region behind the key frame 110. Thus, it is possible to secure a space behind the key frame 110; consequently, interference between the flat cable 40 and the hammer structure 3 can be effectively avoided. In this way, the instant embodiment can readily provide an appropriate weight feeling by virtue of an increased volume of the end portion of the mass rod 31 of the hammer structure 3. If the space secured behind the key frame is small, there would arise a need to increase the overall height of the keyboard apparatus in order to provide an appropriate weight feeling; the instant embodiment arranged in the above-described manner can eliminate such a need.

In each of the key units 1 and 2 integrally formed of synthetic resin, the common fixation section 13 or 23 and keys 11 or 21 are connected together via the respective small-thickness portions 12 or 22, and the keys 11 or 21 are pivotable relative to the common fixation section 13 or 23 by the resiliency of the small-thickness portions 12 or 22. Further, each of the hammer structures 3 is pivotably provided beneath the corresponding key 11 or 21 and pivots in interlocked relation to depression operation of the corresponding key 11 or 21. In the black key unit 2, the actuating portion 24 is formed on the underside surface of the distal end of each of the black keys 21, while, in the white key unit 1, the actuating portion 14 is formed on the underside surface of at least the wide portion 11*a* of each of the white keys 11 adjacent to the distal end of the black key 21.

Therefore, the actuating portion 24 of the black key 21 and the actuating portion 14 of the white key 11 can be substantially equidistant from the respective common fixation sections 13 and 23, and the actuating portions 14 and 24 can be located as close as possible to the distal ends of the keys 11 and 21. In this way, the hammer structures 3 for the black and white keys can be constructed in generally the same manner. Besides, because impacts, on the small-thickness portions 12 and 22, of reactive forces applied from the hammer structures 3 can be effectively reduced by virtue of considerable distances of the actuating portions 14 and 24 from the small-thickness portions 12 and 22, the key touch feeling will not be damaged. Further, because the actuating portion 14 of the white key 11 is provided on the wide portion 11*a*, boundary corners between the wide portion 11*a* and the narrow portion 11*b* is located closer to the common fixation section 13 than the actuating portion 14. Thus, a key-depressing force applied by a finger of the human player is transmitted directly to the actuating portion 14 on the wide portion 11*a*, and a force applied to the boundary corners mainly comprises a pull force acting in a depth direction of the white key 11; as a consequence, the reactive force is effectively prevented from concentrating on the boundary corners, which can achieve an enhanced durability.

Further, as set forth above, the white key unit 1 comprises a plurality of the white keys 11 integrally formed via the common fixation section 13, and the black key unit 2 comprises a plurality of the black keys 21 integrally formed via the common fixation section 23. Such integral formation of the keys can significantly reduce the manufacturing cost of the keyboard apparatus.

Further, because each of the hammer structures 3 imparts, by the empty weight of the mass rod 31, a biasing force to the actuating portion 14 or 24 of the key 11 or 21 in an opposite direction from the key-depressing force applied by the human player, the key 11 or 21 can return to its original position by the empty weight of the hammer structure 3 plus the resilient force of the small-thickness portion 12 or 22 of the key unit 1 or 2. Therefore, in this case, no particular key-returning means, such as a spring, is required, so that the flat cable 40 can be installed or wired with an even further increased ease.

As seen in FIG. 2A, the actuating portions 14, 24, 14, 24, . . . provided on the underside surfaces of the white and black keys 11 and 21 are spaced apart at substantially equal intervals in the key-arranged direction. For the adjoining "B" and "C" keys and adjoining "E" and "F" keys, however, the intervals between the actuating portions 14-B and 14-C and between the actuating portions 14-E and 14-F are slightly greater than such intervals for the other keys. This is because, for the "E" and "E" keys in the instant embodiment, the actuating portion 14-C is provided on the wide portion 11*a* of the key 11 at a position slightly displaced toward the centerline of the key. For the "B" and "F" keys too, the actuating portion 14-B may be provided on the wide portion 11*a* of the key 11 at a position slightly displaced toward the centerline of the key. Alternatively, for both the "B" and "C" keys and the "E" and "F" keys, the actuating portions 14-B and 14-C and actuating portions 14-E and 14-F may each be provided on the wide portion 11*a* of the key 11 at a position slightly displaced toward the centerline of the key.

Figure 5:
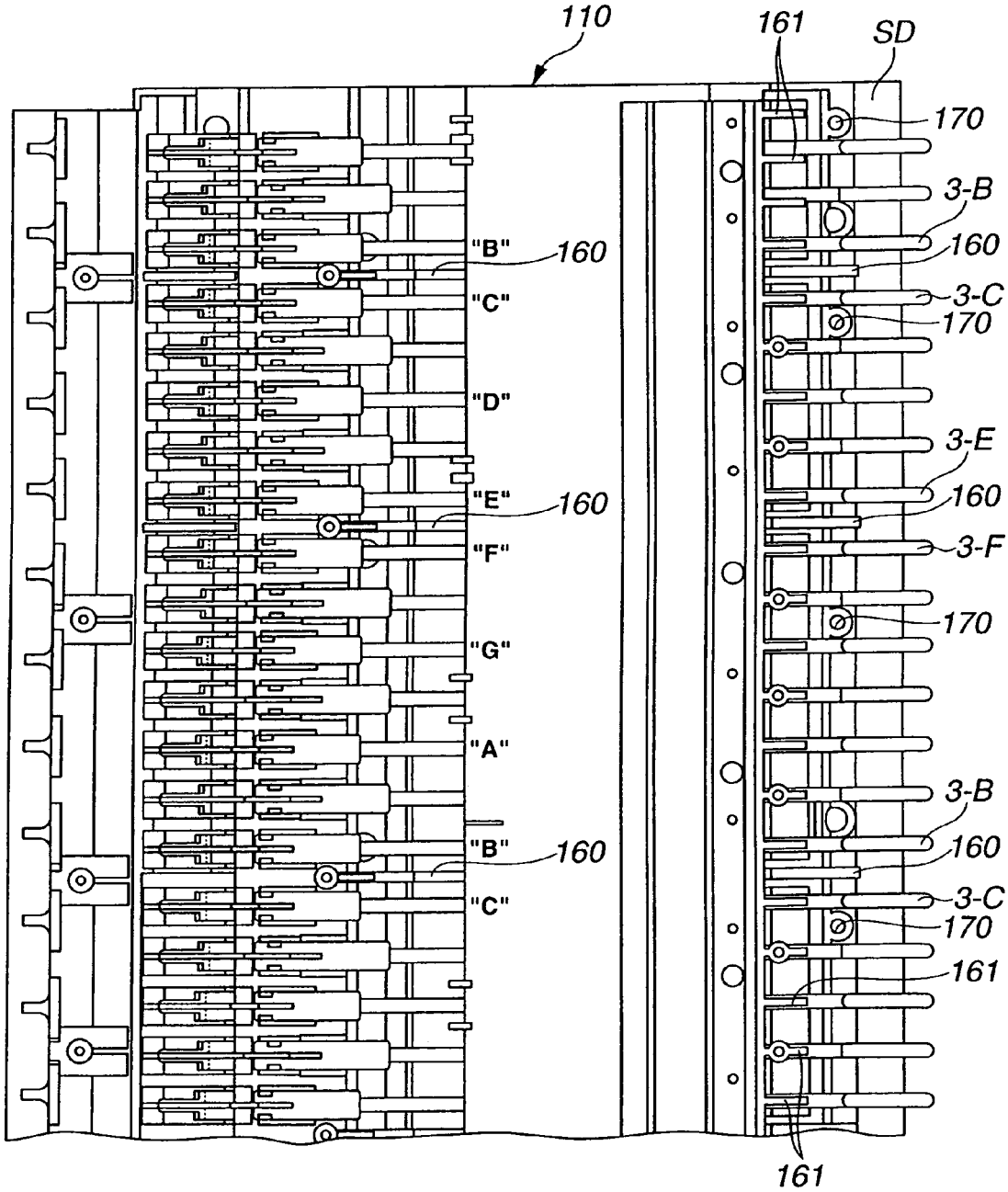
FIG. 5 is a plan view showing a key frame and hammer structures in the embodiment of the keyboard apparatus.

FIG. 5 is a plan view showing the key frame 110 and hammer structures 3 with the key units removed for clarity. On an upper rear portion of the key frame 110, there are provided a plurality of ribs 161 on the upper stopper SU to retain the upper stopper SU. Note that illustration of the upper stopper SU under the ribs 161 is omitted. The hammer structures 3 are disposed at substantially equal intervals, but the interval between the hammer structures 3-B and 3-C for the adjoining "B" and "C" keys and the interval between the hammer structures 3-E and 3-F for the adjoining "E" and "F" keys are slightly greater than the intervals between the hammer structures for the other keys. Vertical ribs 160, extending in the front-rear direction of the keyboard apparatus are provided between the hammer structures 3-B and 3-C and between the hammer structures 3-E and 3-F.

Because no black key 21 is provided between the "B" and "C" keys and between the "E" and "F" keys and because the actuating portions 14-B, 14-C, 14-E and 14-F have some positioning freedom, the instant embodiment not only permits increase in the intervals between the actuating portions 14-B and 14-C, between the hammer structures 3-B and 3-C, between the actuating portions 14-E and 14-F and between the hammer structures 3-E and 3-F but also permits provision of the ribs 160, as set forth above. The ribs 160 are provided to increase the rigidity of the key frame 110. With such ribs 160 positioned only between the "B" and "C" keys and between the "E" and "F" keys as in the above-described embodiment, the necessary number of the ribs can be minimized, which can effectively reduce the overall weight of the keyboard apparatus.

Further, the hammer structures 3 for the white key and black key are slightly different in shape, with a view to slightly differentiating the hammer action between the white and black keys. However, the hammer structures 3-B and 3-C and the hammer structures 3-E and 3-F, provided on the opposite sides of the respective ribs 160, are of the same construction. Therefore, on the opposite sides of the respective ribs 160, these hammer structures 3-B and 3-C and hammer structures 3-E and 3-F operate in the same manner; thus, it is easy to design the keyboard apparatus in such a manner as to effectively avoid interference between the ribs 160 and the hammer structures 3-B and 3-C and hammer structures 3-E and 3-F.

Furthermore, screw holes 170 for passing therethrough the screws N3 to fix a rear end portion of the key frame 110 are formed inwardly or forwardly of the stoppers SD (i.e., at positions closer to the human player than the lower stopper SD). Thus, in this case, the dimension (width), in the front-rear direction, of the key frame 110 can be reduced as compared to the case where such screw holes are formed outwardly or rearwardly of the lower stopper SD. Besides, the screw holes 170 are formed between the hammer structures 3, and thus, a screw driver etc. will not interfere with the hammer structures 3 even when the key frame 110 is screwed to the lower case 10D from above the lower case 10D. Therefore, assembly of the keyboard apparatus is facilitated. If the key frame 110 is screwed to the lower case 10D from above the lower case 10D as set forth above, the key frame 110 can be fixed to the lower case 10D without the keyboard apparatus 100 being turned over. Only screwing the key frame 110 to the lower case 10D from above the lower case 10D, using the screw holes 170, as set forth above permits appropriate positioning of screw holes associated with the other screws N1 and N2. Thus, assembling performance will not be damaged even if the key frame 110 is fixed, by means of the screws N1 and N2, to the lower case 10D from below the lower case 10D with the keyboard apparatus 100 being turned over.

Note that, on the upper rear portion of the key frame 110, there are provided the plurality of ribs 161 at positions, other than the position where the retaining member 150 is located, on the upper stopper SU. In other words, no such rib 161 is provided at the position where the retaining member 150 is located, and the wall section of the retaining member 150 performs a reinforcing function in place of the ribs 161.

What is claimed is:

1. A keyboard apparatus comprising:

a plurality of keys;

a key frame that pivotably supports said plurality of keys by a key support section thereof;

a circuit board provided below the keys and having switches corresponding to the keys;

a plurality of hammer structures pivotably provided on said key frame in corresponding relation to and below the keys, each of said hammer structures pivoting in interlocked relation to depression operation of a corresponding one of the keys;

an upper stopper provided on a rear portion of said key frame and elongated and extending in a direction where the keys are arranged, said upper stopper defining an upper end limit of pivoting movement of each of said hammer structures, an opening portion being formed between the key support section and said upper stopper; and an upwardly-opening wall section provided on said key frame above said upper stopper in positional correspondence with said opening portion formed between the key support section and said upper stopper, wherein a wiring cable connected to said circuit board is run below the key support section of said key frame, then passed through the opening portion and thence drawn upwardly beyond said upper stopper so that the wiring cable is led out to a region behind said key frames, wherein the wiring cable drawn upwardly beyond said upper stopper through the opening portion is led out rearwardly to the region through an upward opening of the wall section, and wherein the upward opening of the wall section is located at a same height as or higher than an uppermost end of said hammer structures when said hammer structure are held by said upper stopper.

2. A keyboard apparatus as claimed in claim 1 wherein said plurality of keys are included in a key unit, the key unit is integrally formed of synthetic resin to provide a fixation section and small-thickness portions, and said plurality of keys are connected with the fixation section via respective ones of the small-thickness portions, the keys being pivotable relative to the fixation section by resiliency of the respective small-thickness portions, and wherein the fixation section is supported by the key support section of said key frame.

3. A keyboard apparatus as claimed in claim 1 wherein a plurality of ribs are provided on a rear portion of said key frame at positions other than a position where the wall section is located, and said upper stopper is provided below the plurality of ribs and the wall section.

4. A keyboard apparatus as claimed in claim 1 wherein the wiring cable is a flexible flat cable comprising a plurality of wiring lines combined together.

* * * * *